US006789533B1

(12) United States Patent
Hashimoto et al.

(10) Patent No.: US 6,789,533 B1
(45) Date of Patent: Sep. 14, 2004

(54) ENGINE CONTROL SYSTEM

(75) Inventors: Kohji Hashimoto, Tokyo (JP); Katsuya Nakamoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/757,993

(22) Filed: Jan. 16, 2004

(30) Foreign Application Priority Data

Jul. 16, 2003 (JP) ..... P2003-275614

(51) Int. Cl.[7] ..... F02D 41/00
(52) U.S. Cl. ..... 123/672; 123/674; 123/434
(58) Field of Search ..... 123/672, 674, 123/676, 679, 697, 689, 434

(56) References Cited

U.S. PATENT DOCUMENTS 5,111,792 A * 5/1992 Nagai et al. ..... 123/440

FOREIGN PATENT DOCUMENTS

JP 1-172746 A 7/1989
JP 11-237360 A 8/1999
JP 11-281617 A 10/1999
JP 2001-349864 A 12/2001

* cited by examiner

*Primary Examiner*—Bibhu Mohanty
(74) *Attorney, Agent, or Firm*—Sughrue Mion, PLLC

(57) ABSTRACT

An engine control system provides a gas concentration detection output irrespective of variation in product or change due to passage of time using an on-vehicle exhaust gas sensor. An exhaust gas sensor 107 and an electric heater 119 are connected to a microprocessor 120*a*, and an oxygen-concentration detection output Ip of exhaust gas, a calibration signal Vc and an internal resistance detection signal Vr are inputted through A/D converter 125. A program memory 121*a* stores standard characteristic data of the exhaust gas sensor 107. An atmospheric air oxygen-concentration detection output Ip0 under fuel-cut drive is measured and monitored. The electric heater 119 controls temperature so that the output coincides with the stored value. Current internal resistance of the exhaust gas sensor 107 is read and stored as target resistance. In normal driving, the electric heater 119 is controlled so that the internal resistance becomes the target resistance.

10 Claims, 8 Drawing Sheets

| AIR-FUEL RATIO | (A/F) 1 | (A/F) 2 | (A/F) 3 | (A/F) 4 | (A/F) 5 | Air |
|---|---|---|---|---|---|---|
| OXYGEN CONCENTRATION | Ip1 | Ip2 | Ip3 | Ip4 | Ip5 | Ip0 |

| | | | |
|---|---|---|---|
| | LOWER LIMIT | TEMPORARY TARGET VALUE | UPPER LIMIT |
| INTERNAL RESISTANCE | R1 | R0 | R2 |

ENGINE CONTROL SYSTEM

BACKGROUND OF THE INVENTION

1. Field of the Invention

The present invention relates to an engine control system improved in accuracy of detecting an air-fuel ratio in a vehicle equipped with an internal combustion engine capable of carrying out feedback control of the air-fuel ratio.

2. Description of the Related Art

Hitherto, concentration of oxygen in exhaust gas of the internal combustion engine (hereinafter referred to as engine) installed in the vehicle is measured with an exhaust gas sensor, and a ratio of air to fuel (hereinafter referred to as air-fuel ratio) of air-fuel mixture supplied to the engine is controlled on the basis of the measured oxygen concentration in order to purify the exhaust gas and improve fuel consumption. In order to mass-produce automobiles and make them stably work over a long term of years, it is necessary to use exhaust gas sensors of stable operation that do not widely vary in characteristic and show less aged deterioration due to use. Therefore, several technical attempts to compensate the variation in characteristic and aged change and modify the characteristic have been heretofore developed and laid open to the public.

For example, in a generally known technique, an electric heater is used in combination with the exhaust gas sensor in general, and a gas-sensing portion of the exhaust gas sensor is controlled to be at an appropriate activation temperature by monitoring internal resistance of the exhaust gas sensor or the electric heater when the exhaust gas sensor is used.

The exhaust gas sensors vary in detection characteristic of the air-fuel ratio to the oxygen concentration and change in characteristic with the passage of time depending upon each individual gas sensor. Further, internal resistance, on which the temperature control is based, also varies in characteristic and changes with the passage of time.

The Japanese Patent Publication (unexamined) No. 1999-281617 titled 'Gas Sensor, Connector of Gas Sensor, and Gas Concentration Detecting Device' discloses a technique to compensate variation in detection characteristic of the sensors by attaching a calibration resistor to each exhaust gas sensor.

The Japanese Patent Publication (unexamined) No. 1998-169500 titled 'Output Compensating Device of Air-Fuel Ratio Sensor' discloses an output compensating device of an air-fuel ratio sensor that includes an air-fuel ratio sensor for detecting air-fuel ratio of gas in exhaust passage of the engine, output detection means for detecting output of the air-fuel ratio sensor when the gas in the exhaust passage of the engine is in a state of a predetermined air-fuel ratio, and output compensation means for compensating output of the air-fuel ratio sensor on the basis of the output detected by the mentioned output detection means. The state of the foregoing predetermined air-fuel ratio indicates a state of atmospheric environment during cutting the fuel or during stopping the engine.

The Japanese Patent Publication (examined) No. 1992-24657 titled 'Method and Apparatus for Measuring Temperature of Limit Current Zonde or λ Zonde' discloses that internal resistance of an exhaust gas sensor is detected in the form of temperature detecting means at the time of controlling an electric heater for keeping the exhaust gas sensor at an appropriate activation temperature.

The Japanese Patent Publication (unexamined) No. 1989-172746 titled 'Apparatus for Controlling Heater Temperature of Oxygen-concentration Sensor' discloses that internal resistance of an electric heater is detected in the form of temperature detecting means at the time of controlling an electric heater for keeping the exhaust gas sensor at an appropriate activation temperature.

The Japanese Patent Publication (unexamined) No. 2001-349864 titled 'Temperature Detector for Exhaust Gas Sensor' discloses variation-calibrating means in internal resistance of exhaust gas sensors depending upon each individual product.

In every foregoing prior arts, a problem exists in that characteristic of the exhaust gas sensor that has varied with the passage of time is not compensated and, moreover, it is necessary to keep the environmental temperature of the exhaust gas sensor at a predetermined value with accuracy in order to avoid any error in oxygen-concentration data.

Moreover, although it is possible to carry out initial calibration of the exhaust gas sensor without using expensive calibration gas, it is not possible to compensate the variation in characteristic depending upon products and change in characteristic due to the passage of time.

Even if the internal resistance detecting means aiming at temperature control is improved, it is not possible to compensate the variation in characteristic depending upon products and the change in characteristic due to the passage of time.

In detecting the internal resistance for temperature control, the calibration means for calibrating the variation in characteristic of products and change in characteristic due to the passage of time depends on outside air temperature of the vehicle. Therefore, a further problem exists in the prior arts that it is difficult to correctly calibrate the temperature characteristic of a high-temperature activation region. Even if the temperature is correctly controlled; it is yet not possible to accurately detect the oxygen concentration because the sensors vary in oxygen-concentration detection characteristic and the characteristics change with the passage of time.

SUMMARY OF THE INVENTION

The present invention has been made to solve the above-discussed problems, and a first object of the invention is to provide an engine control system provided with -an exhaust gas sensor including a calibration resistor for oxygen-concentration detection output (hereinafter referred to also as oxygen-concentration data) the engine control system being capable of obtaining accurate oxygen-concentration data regardless of any change in oxygen-concentration detection characteristic due to the passage of time and any variation in internal resistance for temperature control depending upon products and in internal resistance due to the passage of time.

A second object of the invention is to provide an engine control system capable of detecting deterioration in characteristic of the exhaust gas sensor and automatically displaying a warning.

An engine control system according to the invention includes:

an exhaust gas sensor having a sensor element that is provided with an electric heater for controlling temperature near the sensor element and appropriately operating at a predetermined activation temperature, measuring oxygen concentration of exhaust gas of the engine and outputting oxygen-concentration data, and outputting predetermined oxygen-concentration data when the mentioned exhaust gas is in an atmospheric air exchange state and the temperature near the mentioned sensor element is at the predetermined activation temperature;

a standard characteristic storage memory in which a functional expression or a data table showing a relation between the mentioned oxygen-concentration data and an air-fuel ratio of the mentioned engine at the mentioned predetermined activation temperature and oxygen-concentration data in the mentioned atmospheric air exchange state are stored;

atmospheric air judging means for judging an atmospheric air state to determine that the mentioned exhaust gas is in an atmospheric air exchange state that the exhaust gas has been exchanged with the mentioned atmospheric air when fuel supply to the mentioned engine has been stopped exceeding a predetermined time;

first heater control means that controls the mentioned electric heater so that the mentioned oxygen-concentration data coincide with the oxygen-concentration data stored in the mentioned standard characteristic storage memory when the mentioned atmospheric air state judging means judges that the exhaust gas is in the atmospheric air state;

calibration signal reading means that stores internal resistance of the mentioned exhaust gas sensor or internal resistance of the mentioned electric heater at the point of time when the oxygen-concentration data outputted by the mentioned exhaust gas sensor being controlled by the mentioned first heater control means comes to coincide to the mentioned standard value data as a target internal resistance;

second heater control means that operates when fuel is supplied to the mentioned engine to control the foregoing electric heater so that a current value of the measured internal resistance of the mentioned exhaust gas sensor or the electric heater coincides to the mentioned target internal resistance; and air-fuel ratio calculating means that has a microprocessor and calculates the current air-fuel ratio on the basis of the current oxygen-concentration data of the mentioned exhaust gas sensor controlled by the mentioned second heater control means and the mentioned functional expression or data table stored in the mentioned standard characteristic storage memory.

In the engine control system according to the invention, while keeping the oxygen-concentration data in the atmospheric air state at a calibration initial value at all times, and the air-fuel ratio is calculated on the basis of the detected oxygen-concentration data, and fuel supply is controlled so that the calculated air-fuel ratio becomes the target air-fuel ratio. As a result, it is possible to avoid influence of variation in characteristic of the exhaust gas sensor and the electric heater and change in characteristic due to the passage of time by carrying out initial calibration on the oxygen-concentration data.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Embodiment 1

The whole constitution of the engine control system according to Embodiment 1 of the present invention is hereinafter described with reference to FIG. 1.

Figure 1:
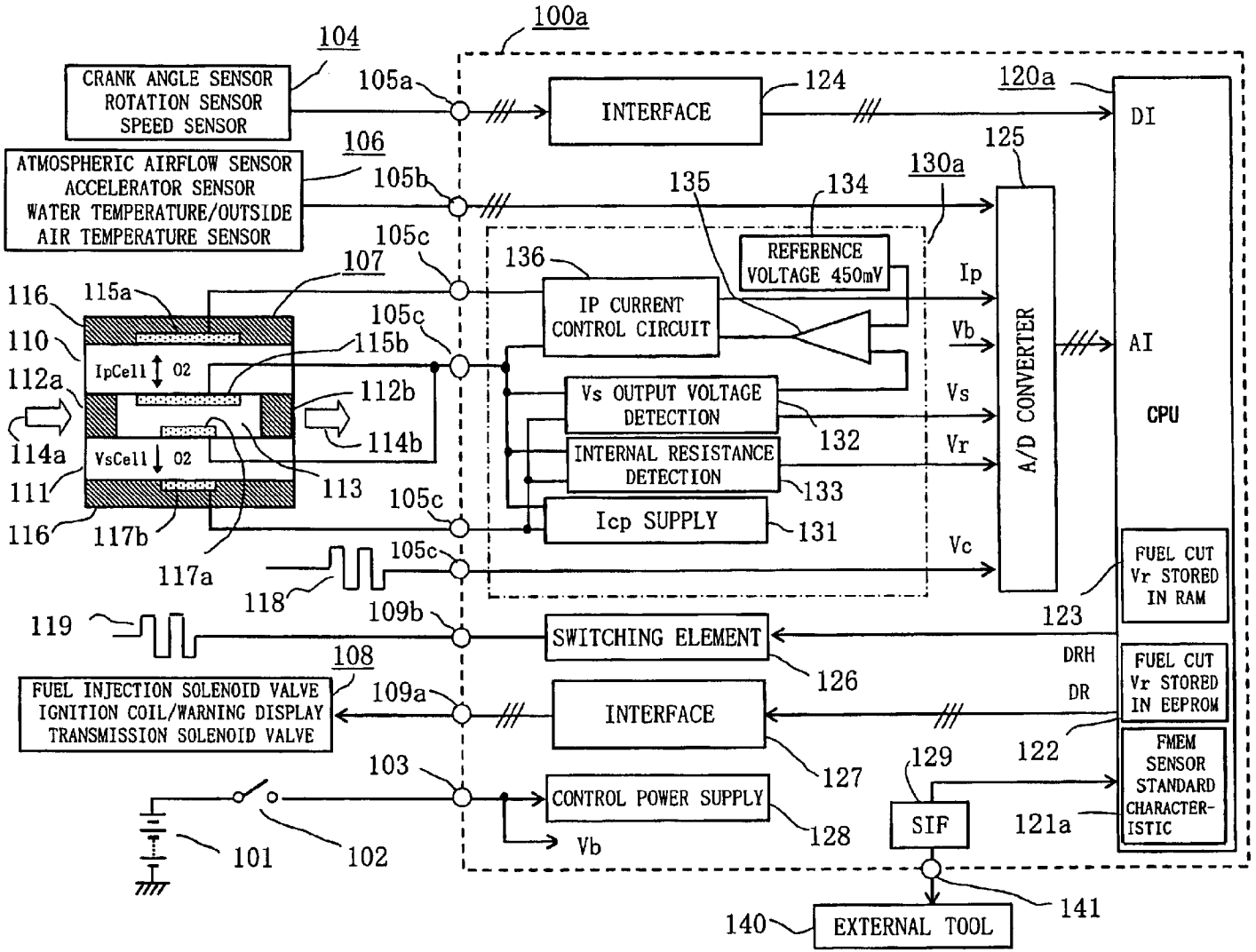
FIG. 1 is a block diagram showing a constitution of an engine control system according to Embodiment 1 of the present invention.

FIG. 1 shows an engine control system 100*a* supplied with electric power from a battery 101 such as 12 volt battery mounted on a vehicle not shown through a supply of power switch 102 and a supply of power terminal 103. This engine control system 100*a* includes fuel injection control means (fuel injector is not shown) of this engine (not shown).

A pulse output type on-vehicle sensor group 104 including sensors such as crank angle sensor, engine rotation sensor, speed sensor is connected to the engine control system 100*a* through an input terminal group 105*a*.

An on-vehicle sensor group 106 including sensors that generate analog signals such as airflow sensor, accelerator sensor, water temperature sensor, outside air temperature sensor is also connected to the engine control system 100*a* through an input terminal group 105*b*.

Further, an exhaust gas sensor 107 is connected to the engine control system 100*a* through an input terminal group 105*c*. A fuel injection solenoid valve, an ignition coil, a warning display, a transmission solenoid valve, and so on (hereinafter referred to as on-vehicle electric load group) 108 are also connected to the engine control system 100*a* through an output terminal group 109*a*.

An electric heater 119 (described later in detail) is connected to an output terminal 109*b*.

The exhaust gas sensor 107 includes protective layers 116 arranged at two ends of the exhaust gas sensor 107, an oxygen pump element 110 composed of a zirconia solid electrolyte material, an oxygen-concentration cell element 111 composed of a zirconia solid electrolyte material, and a pair of gas passage walls 112*a* and 112*b* composed of a gas diffusion porous material. The oxygen pump element 110, the oxygen-concentration cell element 111, and the pair of gas passage walls 112*a* and 112*b* form a gas-detecting chamber 113. Exhaust gas discharged from the engine flows as indicated by the arrows 114*a* and 114*b* indicating the direction the exhaust gas passes. A part of the exhaust gas flow not shown flows from the mentioned gas passage wall 112*a* into the gas-detecting chamber 113, then passing through the gas passage wall 112*b*, is discharged.

The oxygen pump element 110 has a pair of pump element electrodes 115*a* and 115*b* on its two faces. The oxygen-concentration cell element 111 has a pair of cell element electrodes 117*a* and 117*b* on its both faces. Each of those electrodes is connected to the engine control system 100*a* through the input terminal group 105*c*.

The exhaust gas sensor 107 is provided with a calibration resistor 118, and has the ceramic electric heater 119 integrally formed with the exhaust gas sensor 107.

The engine control system 100*a* contains therein a non-volatile program memory 121*a* such as flash memory, a nonvolatile data memory 122 such as FEPROM, a microprocessor 120*a* cooperating with an arithmetic memory 123 acting as a RAM memory, and an input interface circuit 124 consisting of signal voltage level conversion, noise filter function, and data selector function. Input signals from the sensor group 104 are inputted to the microprocessor 120*a* through the input interface circuit 124.

A multichannel analog-to-digital converter 125 converts analog signals inputted from the analog sensor group 106 and other analog signals described later into digital signals and inputs the digital signals to the microprocessor 120*a*. A power transistor-switching element 126 is driven by the microprocessor 120*a* at a variable on/off ratio and controls supply of power to the electric heater 119.

An interface 127 is comprised of an output latch memory, a power transistor, etc., and the microprocessor 120*a* drives and controls the electric load group 108. A control power supply circuit 128 is supplied with power through the supply of power switch 102. The mentioned control power supply circuit forms a stabilizing power source of DC 5 V and supplies power to required parts such as respective circuit elements in the engine control system 100*a*.

An arbitrary input-output device (hereinafter referred to as external tool) 140 is connected through a detachable connector 141 at the time of dispatch or maintenance of the engine control system 100*a* or whenever necessary and serially communicates with the microprocessor 120*a* through a tool interface circuit 129.

A sensor interface circuit 130*a* is arranged with respect to the exhaust gas sensor 107. The sensor interface circuit 130*a* includes an oxygen reference generation current (Icp) supply circuit 131 that supplies a very small electric current of approximately 10 to 25 $\mu$A to the oxygen-concentration cell element 111, thus using the cell element electrode 117*b* side as an oxygen reference.

Figure 2:
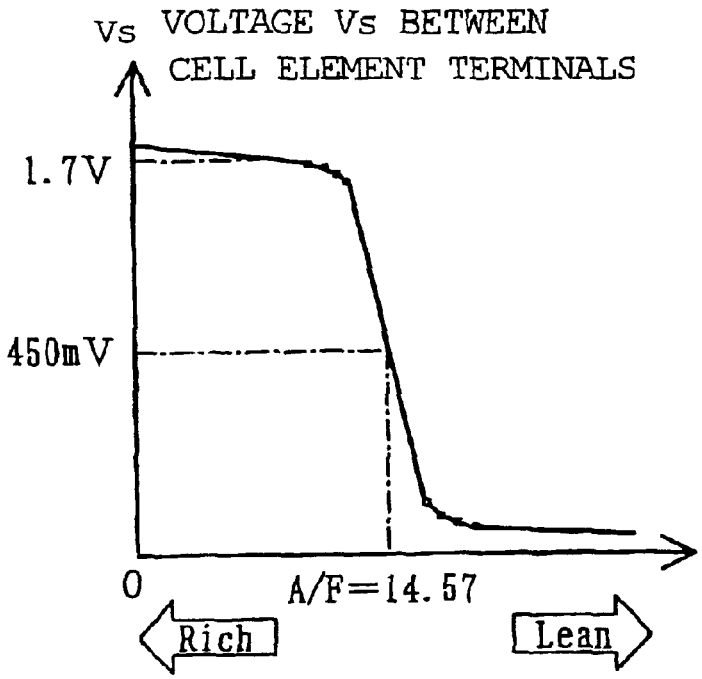
FIGS. 2(*a*) and (*b*) are graphic diagrams each showing a characteristic of an exhaust gas sensor.
Figure 2:
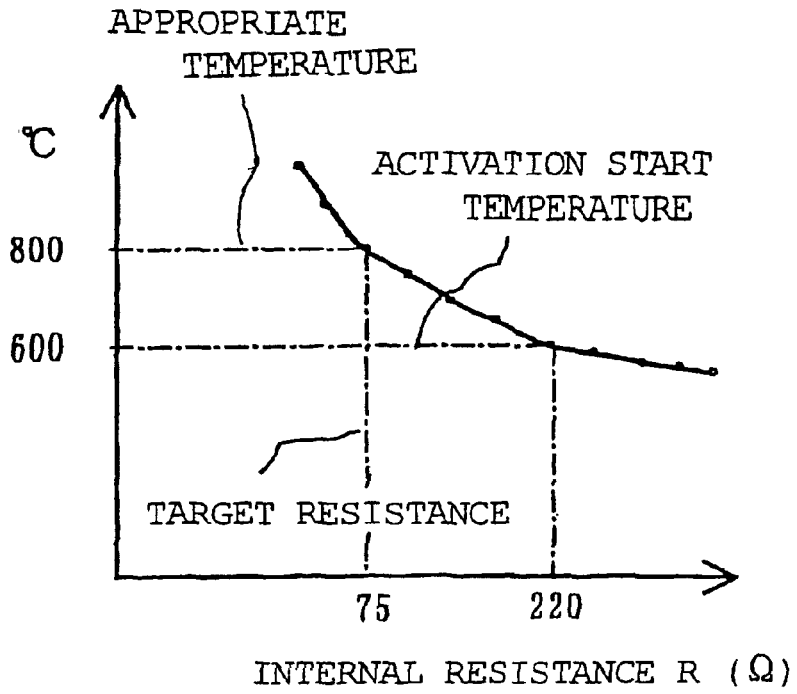

The voltage detected by a circuit 132 for detecting voltage between cell element terminals is, for example, 450 mV when the theoretical air-fuel ratio A/F=14.57 as shown in FIG. 2(*a*).

An internal resistance detection circuit 133 is arranged so that a high-frequency electric current is supplied to the oxygen-concentration cell element 111 for a short period of time at regular intervals of, for example, approximately 100 msec, and sampling of high-frequency voltage is carried out, whereby an internal resistance is obtained from an internal impedance calculated on the basis of the ratio.

The internal resistance is measured with a high-frequency electric current for the purpose of eliminating influence of the electrode surface resistance. Electrostatic capacity components of relatively large capacities are parasitic on the mentioned surface resistance in parallel, and therefore the surface resistance shows a low impedance characteristic with respect to a high-frequency electric current.

It is necessary to calculate the ratio of the impedance Z=V0/I in the case of measuring a high-frequency electric current I with a constant high-frequency voltage V0 applied. However, in the case where a constant high-frequency electric current I0 is supplied and a voltage V of the supplied electric current is measured, the impedance Z=V/I0∝V, and therefore it is possible to omit such a complicated ratio calculation.

FIG. 2(*b*) shows a relation between the internal resistance R calculated as described above and temperature of the exhaust gas sensor 107. When temperature of the exhaust gas sensor 107 is the appropriate activation temperature 800° C., which is a target value in the temperature control, the internal resistance R is 75 Ω.

A reference voltage generating circuit 134 generates 450 mV, which is a target value of the voltage Vs between the cell element terminals.

A comparison control circuit 135 controls a pump current supply circuit 136 so that the voltage Vs between the cell element terminals detected by the voltage detecting circuit 132 for detecting voltage between the cell element terminals becomes equal to the reference value 450 mV.

Oxygen concentration in the gas-detecting chamber 113 increases or decreases according to the intensity and polarity of the pump current Ip supplied by the pump current supply circuit 136. A relation between the air fuel ratio A/F and the pump current Ip is described later with reference to FIG. 3.

For convenience of explanation in the following description, input signals and output signals to the microprocessor 120*a* are indicated as below.

DI indicates a switch input signal group,

AI indicates an analog input signal group,

DRH indicates a heater drive signal, and

DR indicates a load drive signal group.

As for input signals of the foregoing multi-channel analog-to-digital converter 125, Ip indicates oxygen-concentration detection output (oxygen-concentration data) acting as a pump current detection signal, Vs indicates a signal for detecting voltage between cell element terminals, Vr indicates an internal resistance detection signal, Vb indicates a supply of power voltage, and Vc indicates a calibration signal.

Figure 3:
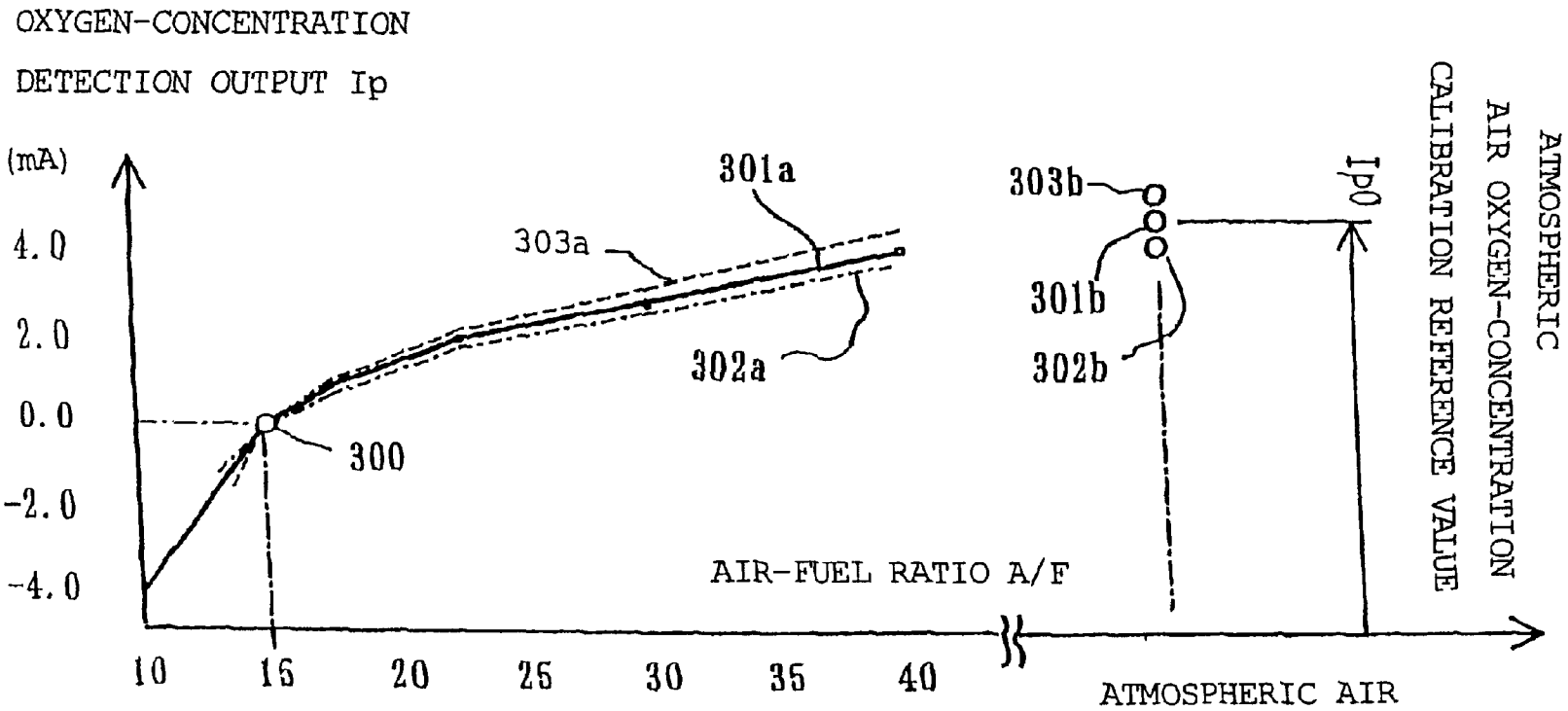
FIG. 3 is a graphic diagram showing characteristic of oxygen-concentration detection output of the exhaust gas sensor.

Referring now to FIG. 3 showing the characteristic of the relation between the oxygen-concentration detection output Ip of the exhaust gas and the air-fuel ratio A/F of gas supplied to the engine, a reference numeral 300 indicates a point at which the oxygen-concentration detection output Ip becomes 0 when the air-fuel ratio A/F is the theoretical air-fuel ratio 14.57, numeral 301*a* indicates a characteristic curve showing the relation between the standard oxygen-concentration detection output and the air-fuel ratio when the exhaust gas sensor 107 is at a predetermined activation temperature T0, and numeral 301*b* indicates an atmospheric air oxygen-concentration standard value Ip0 obtained when the atmospheric air is measured with the standard exhaust gas sensor 107 at the predetermined activation temperature T0.

Actually measured value of the atmospheric air oxygen concentration under the condition that each exhaust gas sensor 107 is in a first article (unused) state is compensated on the basis of a resistance value of the calibration resistor 118, whereby atmospheric air oxygen concentration converted values of the first articles of all the exhaust gas sensors are calibrated so that the converted values are equal to the foregoing standard value Ip0 at the predetermined activation temperature T0.

Numeral 302*a* indicates a low characteristic curve of the exhaust gas sensor 107 in the case where the temperature is lower than the predetermined appropriate activation temperature T0, numeral 302*b* indicates an atmospheric air oxygen-concentration detection output in the case where the atmospheric air is measured with the exhaust gas sensor 107 having the low characteristic curve 302*a*, numeral 303*a* indicates a high characteristic curve of the exhaust gas sensor 107 in the case where the temperature is higher than the appropriate activation temperature T0, and numeral 303*b* indicates an atmospheric air oxygen-concentration detection output in the case where the atmospheric air is measured with the exhaust gas sensor 107 having the high characteristic curve 303*a*.

Now, operation of the engine control system of FIG. 1 is hereinafter described with reference to the drawing.

Referring to FIG. 1, when the supply of power switch 102 is closed and the engine not shown is started, the microprocessor 120*a* drives and controls the on-vehicle electric load group 108 and the electric heater 119 in response to signals from the on-vehicle sensor groups 104 and 106 and the exhaust gas sensor 107.

Particularly, with respect to the fuel injection solenoid valve in the electric load group 108, fuel injection amount is controlled so that the air-fuel ratio becomes a target value while referring to the value of the oxygen-concentration detection output Ip of the exhaust gas. The control program is stored in the standard characteristic storage memory (program memory) 121*a*.

An internal resistance detection signal Vr is used to control the switching element 126 for driving the electric heater 119 so that the value of the detection signal Vr becomes a predetermined target value.

Figure 4:
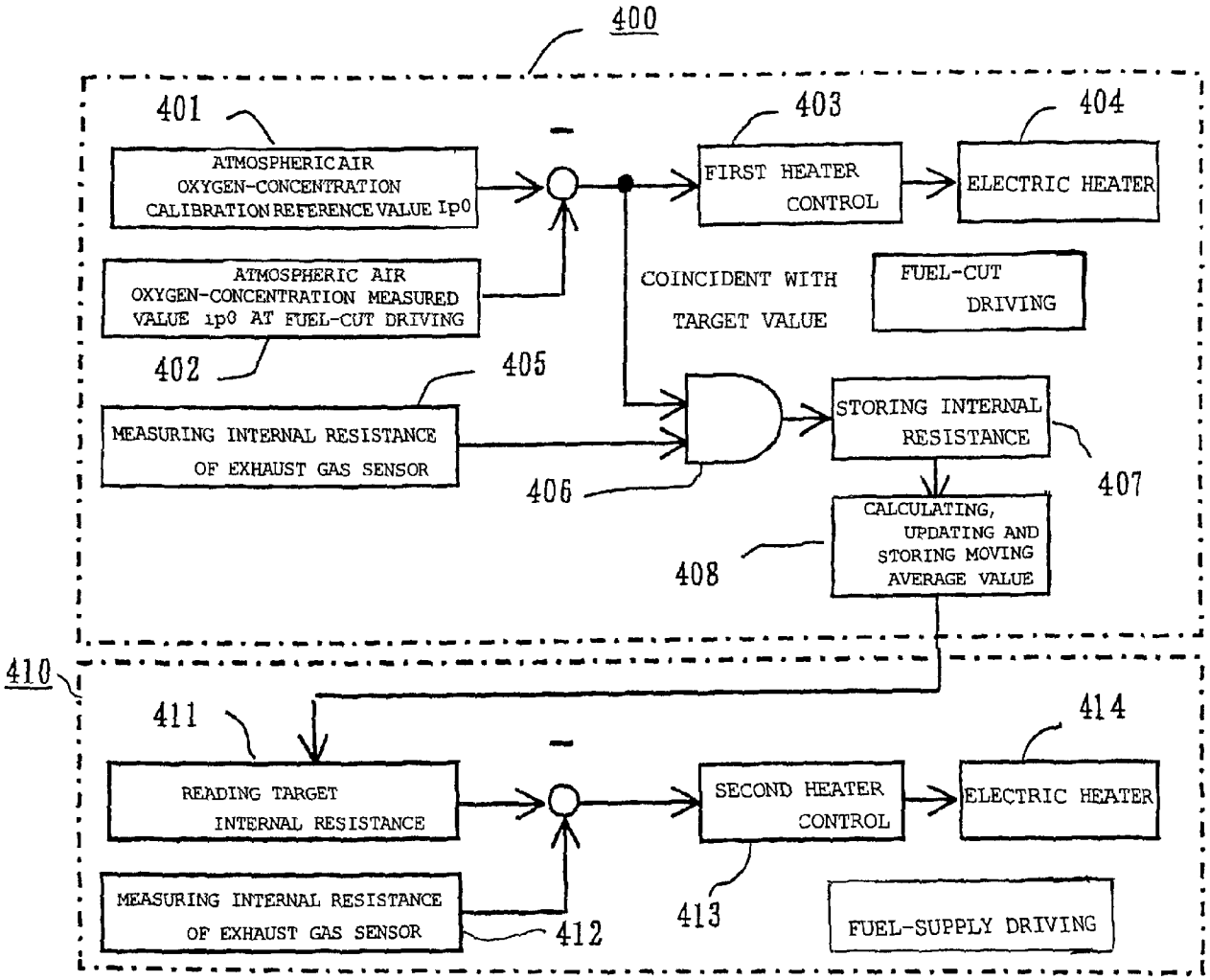
FIG. 4 is a block diagram for explaining control operation of the engine control system in FIG. 1.

FIG. 4 is a control block diagram for explaining operation of the engine control system of FIG. 1.

Reference numeral 400 indicates a whole control block under the condition that the accelerator pedal of the vehicle is returned when the vehicle is coasting on level ground or slowing down on a downgrade and the fuel injection solenoid valve stops fuel supply to the engine (so-called engine braking state). The whole control block 400 is comprised of the following control blocks 401 to 408.

In a setting control block 401, the value of the calibration reference value Ip0 (see FIG. 3) of the atmospheric air oxygen concentration preliminarily stored in the program memory 121*a* is set as a control target value. In a feedback control block 402, the actually measured value of the pump current supplied by the pump current supply circuit 136 is fed back as a current atmospheric air oxygen-concentration detection output ip0 (ip0 is expressed in small letters to distinguish from the target value). In a first heater control block 403, the heater is controlled so that the actually measured value ip0 is equal to the foregoing target value Ip0. In a feeding control block 404, power supplied to the electric heater 119 in the foregoing first heater control block 403 is controlled.

In a measurement control block 405, the internal resistance detection circuit 133 measures the current internal resistance R of the exhaust gas sensor 107. In a transfer control block 407, when the measured value ip0 coincides with the foregoing target value Ip0, the internal resistance R measured in the foregoing measurement control block 405 is read and stored in the arithmetic memory 123 through a gate control block 406. In an arithmetic control block 408, when new information to be read and stored in the transfer control block 407 is produced, the latest information on plural internal resistances R is moving-averaged, updated and stored.

When the exhaust gas sensor 107 is in the first article state, the atmospheric air oxygen-concentration detection output is calibrated to become Ip0 at the predetermined activation temperature T0. Therefore if the actually measured value ip0 is coincident to the target value Ip0 in the first heater control block 403, this means that the environmental temperature of the exhaust gas sensor 107 has become equal to the predetermined activation temperature T0, and the internal resistance stored in the transfer control block 407 is an internal resistance under the condition that the foregoing exhaust gas sensor 107 is in the first article state at the predetermined activation temperature T0.

As a result, even if the exhaust gas sensors 107 vary in internal resistance, the actual internal resistance R at the activation temperature T0 of the foregoing exhaust gas sensor 107 used in the measurement can be calculated.

Consideration is given to a situation that the exhaust gas sensor 107 has been used for a long time and has changed in characteristics with the passage of time, and even if there is any change in atmospheric air oxygen-concentration detection output at the activation temperature T0, the environmental temperature is subject to compensation in the first heater control 403 so that the atmospheric air oxygen-concentration detection output is Ip0 at all times, thereby preventing detection error.

The internal resistance R at the modified environmental temperature is calculated in block 407, and even if the internal resistance has changed with the passage of time, the value of the internal resistance R once stored is used to obtain a necessary modified environmental temperature.

Reference numeral 410 indicates the whole control block under the condition that the accelerator pedal of the vehicle is pressed on and the fuel injection solenoid valve supplies fuel to the engine. The control block 410 is comprised of the following control blocks 411 to 414.

In a setting control block 411, a moving average value of the internal resistance in the arithmetic control block 408 is set as a control target value R0. In a feedback control block 412, the actual internal resistance R of the exhaust gas sensor 107 is measured by the internal resistance detection circuit 133 and fed back. In a second heater control block 413, the heater is controlled so that the measured internal resistance R is equal to the foregoing target internal resistance R0. In a feeding control block 414, power supplied to the electric heater 119 in the foregoing second heater control block 413 is controlled.

As a result, the target internal resistance used in the setting control block 411 is automatically compensated according to the oxygen-concentration detection output Ip of the exhaust gas sensor 107 and the internal resistance R that change with the passage of time, and the temperature is variably controlled so that the atmospheric air oxygen-concentration detection output is Ip0 at all times.

Figure 5:
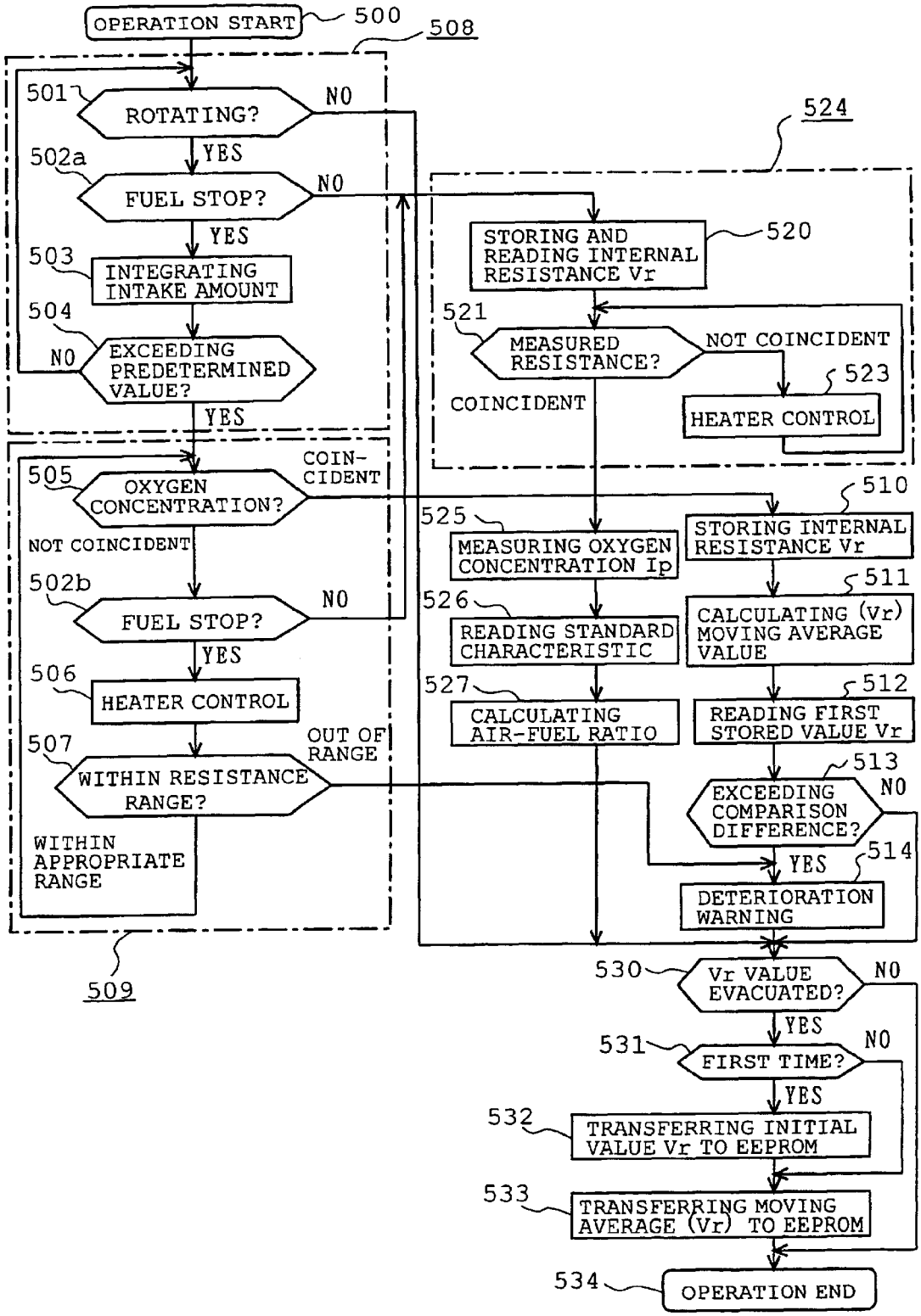
FIG. 5 is a flowchart for explaining operation of the engine control system in FIG. 1.

FIG. 5 shows a flowchart for explaining the operation of the engine control system of FIG. 1. In the following description, each process is also referred to as step with the same meaning. Referring to FIG. 5, step 500 is a step in which the microprocessor 120*a* starts calibration and detection of the exhaust gas sensor 107, and the start step 500 is so arranged as to be activated repeatedly through an operation end step 534 described later.

Step 501 acts subsequently to the foregoing step 500, and whether or not the engine is rotating is judged by monitoring operation of the engine rotation sensor. If the judgment result in the foregoing step 501 is YES and the engine is rotating, then in step 502*a* whether or not fuel supply is stopped is judged by monitoring if the fuel injection solenoid valve is not working. For example, in the case where the accelerator pedal is returning when the vehicle is slowing down on a downgrade or coasting on level ground, fuel supply is stopped.

If the judgment result in the foregoing step 502*a* is YES and fuel supply is stopped, then in step 503, a detection signal of the intake airflow sensor of the engine is subject to integration. This step 503 acts as scavenging air detecting means (or scavenging air judging means) after stopping the fuel supply.

Step 504 acts subsequently to the foregoing step 503, and in which whether or not the value obtained by the integration in step 503 exceeds a predetermined value is judged, and if it is judged that the value obtained by the integration does not exceed the predetermined value, the process returns to the foregoing step 501. If the judgment result in step 504 is YES and the value obtained by the integration exceeds the predetermined value, then in step 505, whether or not the current oxygen-concentration detection output Ip coincides with the standard value data stored in the program memory 121*a* is judged. If it is judged not coincident with the standard value data, then in step 502*b*, whether or not fuel supply is stopped is judged by monitoring if the fuel injection solenoid valve does not work. In step 506, on/off conductance ratio of the switching element 126 is controlled to control supply of power to the electric heater 119. In this step 506, conductance ratio is increased when the current oxygen-concentration detection output Ip is smaller than the standard value data stored in the program memory 121*a*, while the conductance ratio is decreased when the current oxygen-concentration detection output Ip is larger than the standard value data stored in the program memory 121*a*. In this manner, variable control of the environmental temperature is made on the basis of dependence of the oxygen-concentration detection output on the temperature shown in FIG. 3, and feedback control is made so that the judgment result is 'coincident' in the foregoing step 505.

Step 507 acts subsequently to the foregoing step 506, and in which whether or not the internal resistance of the exhaust gas sensor 107 detected by the internal resistance detection circuit 133 is within an appropriate range preliminarily stored in the program memory 121*a* is judged. The process returns to the foregoing step 505 if the internal resistance is within the appropriate range. This judgment step acts as error detecting means.

Step 508 is a block consisting of the foregoing steps 501 to 504, and this step block acts as atmospheric air state judging means under the driving condition.

Step 509 is a block consisting of the foregoing steps 505 to 507, and this step block acts as first heater control means.

When the judgment result is 'coincident' in the foregoing step 505, then in Step 510, the current internal resistance of the exhaust gas sensor 107 detected by the internal resistance detection circuit 133 is transferred and stored as a target internal resistance in the arithmetic memory 123. This storing step acts as calibration signal reading means.

Step 511 acts subsequently to the foregoing step 510, and in which a moving average value of the plural internal resistances stored one after another in the foregoing step 510 is calculated, and the latest moving average value is stored to update. This step 511 acts as moving average means.

Step 512 acts subsequently to the foregoing step 511, and in which the first stored value or the initial average stored value that has been transferred and stored in the data memory 122 in step 532 described later is read out. Step 513 acts subsequently to the foregoing step 512, and in which the moving average value calculated and stored in step 511 is compared with the initial information read out in the foregoing step 512. Then, whether or not the moving average value deviates excessively from the initial information is judged. If it is judged that the deviation is excessive in the foregoing step 513 or if the judgment result is 'out of the range' in step 507, then step 514 acts as a warning display step to give a warning that the exhaust gas sensor 107 or the electric heater 119 has deteriorated, and the foregoing step 513 acts as deterioration detecting means.

Step 520 acts when the judgment result is NO in the foregoing step 502*a* or 502*b* and fuel is supplied to the engine. This step 520 is a target internal resistance read-out selection step in which a temporary target resistance value preliminarily stored in the program memory 121*a* is read out and used in first drive start operation, the moving average value stored in the data memory 122 is read out and used in step 533 described later in normal drive start operation, and the latest moving average value calculated in the foregoing step 511 is used after a new target internal resistance is read out and stored in the foregoing step 510 in a driving situation. This step 520 acts as internal resistance reading means to be used as a target value.

Step 521 acts subsequently to the foregoing step 520 or step 523 described later, and in which whether or not the current internal resistance detected by the internal resistance detection circuit 133 coincides with the target internal resistance read out in step 520 is judged. Step 523 acts when the result of comparison is 'not coincident' in the foregoing step 521, and controlling the on/off ratio of the switching element 126 is made to control supply of power to the electric heater 119. Step 524 is a block consisting of the foregoing steps 520 to 523 and acts as second heater control means in which if any current internal resistance is larger than a target value, the electric heater 119 is supplied with stronger power and heated to lower the internal resistance of the exhaust gas sensor 107, and if the current internal resistance is smaller than the target value, supply of power to the electric heater 119 is decreased to raise the internal resistance of the exhaust gas sensor 107.

Step 525 acts when the judgment result is 'coincident' in the foregoing step 521, and the current oxygen-concentration detection output Ip is read out to the arithmetic memory 123. Step 526 acts subsequently to the foregoing step 525, and in which the standard characteristic of the relation between the oxygen-concentration detection output and the air-fuel ratio preliminarily stored in the program memory 121*a* is read out. Step 527 acts subsequently to the foregoing step 526, a current air-fuel ratio is calculated on the basis of the current oxygen-concentration detection output Ip read out in the foregoing step 525 as well as on the basis of the standard characteristic data read out in this step 526. This step 527 is described later in detail with reference to FIG. 9.

Step 530 acts when the judgment result is NO in the foregoing step 501 or 513 or acts subsequently to the foregoing step 514 or 527. In this step 530, whether or not a part of the data in the arithmetic memory 123 is to be evacuated is judged. For example, the evacuation operation is carried out immediately after the power supply switch 102 is interrupted, and a delay supply of power interrupting circuit not shown continues to supply power to the control power supply circuit 128 until the evacuation operation is completed.

Step 531 acts when it is judged that evacuation operation is to be carried out in the foregoing step 530, and in which whether or not it is the first operation is judged by monitoring if the initial value is written in step 532 described later. Step 532 acts when it is judged the first operation in the foregoing step 531, and in which an average value of the internal resistance of the first time or the internal resistances at the initial stage of starting usage of the exhaust gas sensor 107, which has been read out and stored in the foregoing step 510, is transferred to the data memory 122.

Step 533 acts when it is judged that it is not the first operation in the foregoing step 531 or acts subsequently to the foregoing step 532, and in which the moving average value of the internal resistance updated and stored in the foregoing step 511 is transferred to the data memory 122. Step 534 is an operation end step that acts when it is judged that evacuation operation is unnecessary in the foregoing step 530 or acts subsequently to the foregoing step 533. These steps 532 and 533 act as initial value evacuating and transferring means and current value evacuating and transferring means. In these means, a part of the data in the arithmetic memory 123 is transferred to and stored in the data memory 122 acting as a nonvolatile memory before stopping operation of the engine.

The moving average value (R) of the internal resistance calculated in the foregoing step 511 is obtained by adding n internal resistances R1, R2, . . . Rn read out and stored in step 510 and dividing the sum by n in the latest nth circulation operation step counting from the foregoing operation start step 500 to the operation end step 534. In this respect, the n+1th moving average value (R)' can be calculated by the following expression for convenience.

$$(R)=[R1+R2+\ldots+Rn]/n \quad (1)$$

$$(R)'=[(R)\times(n-1)+Rn+1]/n \quad (2)$$

where: Rn+1 is the measured internal resistance of the n+1th time. In the above equation (2), the latest moving average value and the next detection data are used to calculate the moving average value for the next time. This moving average value is updated and stored, and therefore it is not necessary to memorize many measurement data.

In the stage where number of average data does not reach n, the average value is calculated in the range of such number of data, and this value is used as the moving average value.

The foregoing operation is summarized again as follows. The engine control system according to the first embodiment of the invention described with reference to FIGS. 1 to 5 is established on the fact that the gas in the exhaust pipe turns into a state similar to the atmospheric air (such a state of gas is hereinafter referred to as atmospheric air state or atmospheric air environment) in the case where the accelerator pedal is returned at the time of slowing down the vehicle on a downgrade or coasting it on level ground and fuel supply to the engine has been stopped for more than a predetermined time. The first heater control means 509 makes a heat control of the electric heater 119 so that the individually calibrated oxygen-concentration detection output Ip0 in the atmospheric air state of the exhaust gas sensor is obtained. The internal resistance of the exhaust gas sensor 107 at this stage is measured and stored. Then the second heater control means 524 makes a heat control of the electric heater 119 using the measured and stored internal resistance as a target value during driving the engine with fuel supplied.

As a result, it is possible to avoid influence of variation in internal resistance of the exhaust gas sensor 107. Furthermore, even if the oxygen-concentration detection output characteristic or the internal resistance has changed with the passage of time, a deterioration/error warning is given by the error detecting means in step 507 or the deterioration detecting means in step 513.

Embodiment 2

Figure 6:
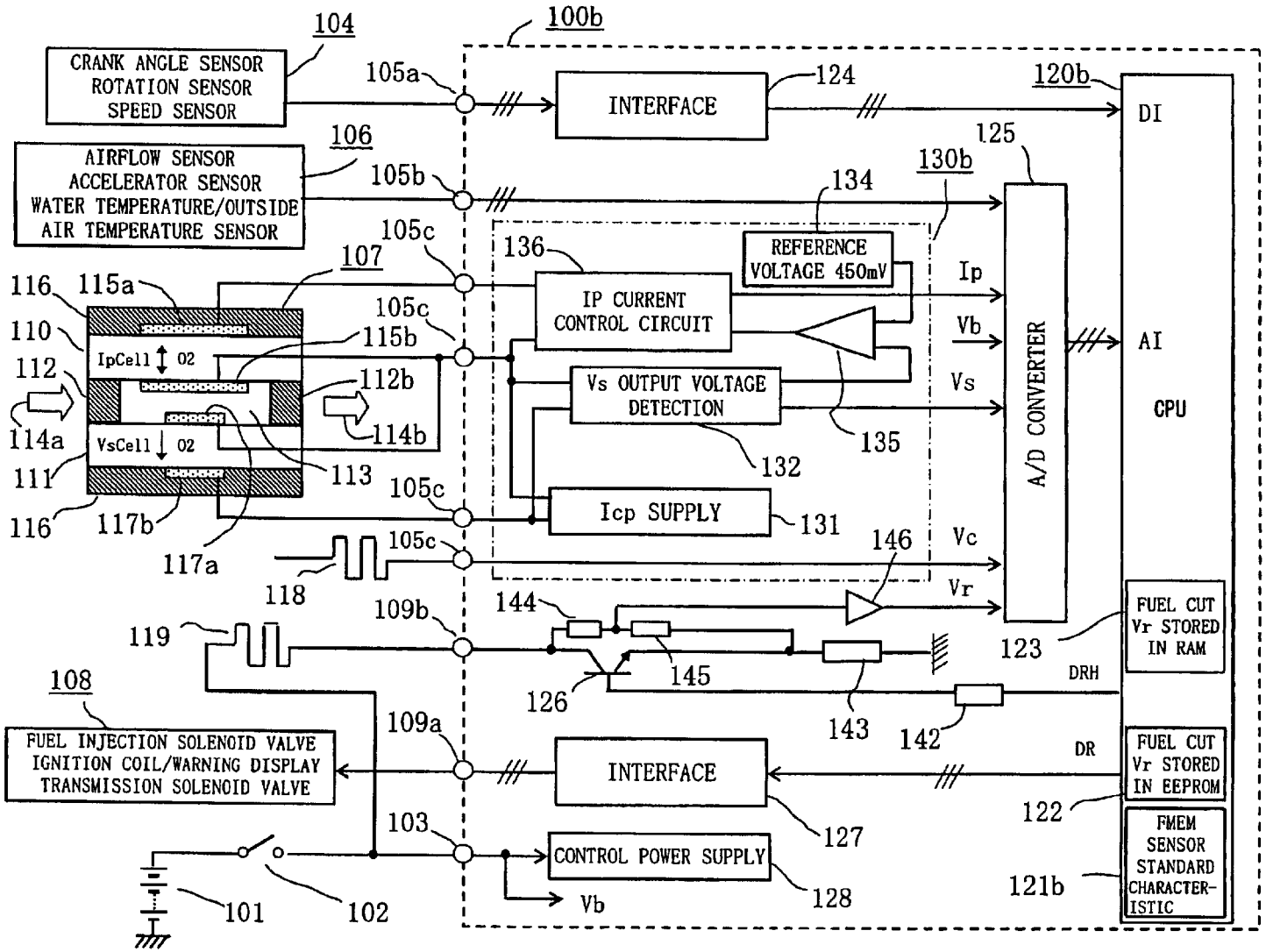
FIG. 6 is a block diagram showing a constitutional of an engine control system according to Embodiment 2 of the invention.

FIG. 6 shows a whole block of a constitution of an engine control system according to Embodiment 2 of the invention. Now, this engine control system is hereinafter described focusing on differences from the engine control system of FIG. 1. Repeated description of the parts same as those in FIG. 1 is omitted herein.

Referring to FIG. 6, reference numeral 100*b* designates an engine control system including a microprocessor 120*b*, a program memory 121*b*, a sensor interface circuit 130*b*, and others. Likewise the engine control system of FIG. 1 according to the foregoing Embodiment 1, this control system includes fuel injection control means for the vehicle engine.

A drive base resistor 142 of the switching element 126 acting as a power transistor for controlling supply of power to the electric heater 119 is connected to a heater drive signal terminal DRH of the microprocessor 120*b*.

An electric current detecting resistor 143 is connected to an emitter circuit of the power transistor 126 acting as the foregoing switching element. A first voltage-dividing resistor 144 and a second voltage-dividing resistor 145 are connected in series, and these voltage dividing resistors connected in series are connected between corrector/emitter terminals of the power transistor 126. An amplifier 146 is connected to the point where the voltage dividing resistors 144 and 145 are connected in series in order to amplify potential of that point and generate a signal voltage Vr. The signal voltage Vr is converted into a digital signal by the multi-channel analog-to-digital converter 125, and subsequently the converted signal is inputted to the microprocessor 120*b*.

The foregoing signal voltage Vr is substituted for the internal resistance detection signal Vr from the internal resistance detection circuit 133 of the exhaust gas sensor 107 in the engine control system of FIG. 1. The internal resistance R of the electric heater 119 is detected as described below.

Supposing that resistance values of the emitter resistor 143 and the first and second voltage dividing resistors 144 and 145 are R143, R144, and R145 respectively (R145>>R143), supply of power voltage of the battery 101 is Vb and amplification factor of the amplifier 146 is G, an internal resistance R of the electric heater 119 is calculated from the following equation.

First, when a heater drive signal DRH of the microprocessor 120*b* is stopped and the switching element 126 is not conducted, $$Vr=G\times Vb\times[(R145+R143)/(R+R144+R145+R143)]\approx G\times Vb\times[R145/(R+R144+R145)] \quad (3)$$

Next, when the switching element 126 is conducted by the heater drive signal DRH of the microprocessor 120*b*, $$Vr=G\times Vb\times[R143/(R+R143)] \quad (4)$$

(In this case, there is a possibility that value of Vr in the equation (3) is different from that of Vr in the equation (4).)

Each internal resistance R is calculated by inverse operation from the foregoing equation (3) or (4) and the target internal resistance R is calculated on the basis of the average of the values obtained from the equation (3) and from the equation (4).

In addition, the internal resistance of the electric heater 119 has a temperature characteristic of positive temperature coefficient in which resistance value increases as the environmental temperature rises, and the temperature near the exhaust gas sensor 107 is detected by detecting the internal resistance.

Next, function and operation of the engine control system arranged as shown in FIG. 6 are hereinafter described.

Referring to FIG. 6, when the power supply switch 102 is closed and the engine not shown is started, the microprocessor 120*b* drives and controls the on-vehicle electric load group 108 and the electric heater 119 in response to signals from the on-vehicle sensor groups 104, 106 and the exhaust gas sensor 107.

Particularly, with respect to the fuel injection solenoid valve in the electric load group 108, fuel injection amount is controlled so that air-fuel ratio becomes a target value on the basis of the value of the oxygen-concentration detection output Ip of the exhaust gas. The control program for that purpose is stored in the program memory 121*b*.

The detection signal Vr for detecting the internal resistance of the electric heater 119 is used to control the switching element 126 for driving the electric heater 119. That is, value of the internal resistance (load resistance) of the electric heater 119, which has been calculated on the basis of the detection signal Vr, is controlled to be a predetermined target value.

Additionally, excluding the differences described below, the control of the electric heater 119 is approximately the same as that in FIG. 4 showing the control block diagram for explaining operation of the engine control system in FIG. 1.

The internal resistance of the electric heater 119 is substituted for the internal resistance R of the exhaust gas sensor 107 in the internal resistance measurement 405 or 412 of the exhaust gas sensor of FIG. 4. The internal resistance R of the electric heater 119 is also substituted for the target internal resistance used in step 407 for storing the internal resistance, step 408 for calculating, updating, and storing the moving average value, and step 411 for reading the target internal resistance.

The operation of the engine control system of FIG. 6 is hereinafter described with reference to the flowchart of FIG. 7. Step 700 is a process in which the microprocessor 120*b* starts calibration and detection of the exhaust gas sensor 107, and the foregoing start step 700 is so arranged as to be activated repeatedly through an operation end step 734 described later.

Step 701 acts subsequently to the foregoing step 700, and in which whether or not it is the first operation is judged by monitoring if an initial operation flag is set in step 703 described later. Step 702*a* acts when the judgment result is YES in the foregoing step 701, i.e., when it is judged the first operation, and in which whether or not the engine is stopped is judged by monitoring the output of the engine rotation sensor. Step 703 acts when the judgment result is YES in the foregoing step 702*a*, i.e., when the engine is stopped, and in which the initial operation flag not shown is set and the current time is read out from a real time clock not shown. Step 704 is carried out after the foregoing current time is read out, and in which whether or not the engine has been stopped for a sufficiently long time is judged by comparing the time when the engine stopped stored in step 733 described later with the time read out in step 703. This step 704 is carried out by time lag detecting means.

If it is judged that the engine has been stopped for a sufficiently long time in the foregoing step 704, then step 705 acts, and in which whether or not the current oxygen-concentration detection output Ip coincides with the standard value data stored in the program memory 121*b* is judged. If it is judged that the current oxygen-concentration detection output Ip does not coincide with the standard value data in the foregoing step 705, then step 702*b* acts, and in which whether or not the engine is stopped is judged by monitoring the operation of the engine rotation sensor.

Step 706 is acts when the on/off conductance ratio control of the switching element 126 is controlled to control supply of power to the electric heater 119. Conductance ratio is increased when the current oxygen-concentration detection output Ip is smaller than the standard value data stored in the program memory 121*b*. On the other hand, the conductance ratio is decreased when the current oxygen-concentration detection output Ip is larger than the standard value data stored in the program memory 121*b*. In this manner, the environmental temperature is variably controlled on the basis of dependence of the oxygen-concentration detection output on the temperature shown in FIG. 3. Feedback control is made so that the judgment result becomes 'coincident' in the foregoing step 705.

Step 707 acts subsequently to the foregoing step 706, and in which whether or not the internal resistance of the electric heater 119 calculated on the basis of the detection signal Vr of FIG. 6 is within an appropriate range preliminarily stored in the program memory 121*b* is judged. If the internal resistance is within the appropriate range, the process returns to the foregoing step 705. This step 707 acts as error detecting means.

Step block 708 consisting of the foregoing steps 701 to 704 acts as atmospheric air state judging means when the engine is stopped.

Step block 709 consisting of steps 705 to 707 acts as first heater control means.

Step 710 acts when the judgment result is 'coincident' in step 705, and the current internal resistance of the electric heater 119 calculated on the basis of the detection signal Vr of FIG. 6 is transferred and stored as a target internal resistance in the arithmetic memory 123. This storing step shows operation of calibration signal reading means.

Step 712 acts subsequently to the foregoing step 710, and in which the first stored value that has been transferred and stored in the data memory 122 in step 732 described later is read out. Step 713 acts subsequently to step 712, and in which the internal resistance calculated and stored in step 710 is compared with the initial information read out in step 712 and whether or not the internal resistance excessively deviates from the initial information is judged. If it is judged that the deviation is excessive in step 713 or if the judgment result is 'out of the range' in the foregoing step 707, then step 714 acts as a warning display step to give a warning that the exhaust gas sensor 107 or the electric heater 119 has deteriorated. This step 714 shows operation of the deterioration detecting means.

Step 720 acts when the judgment result is NO in any of the foregoing steps 701, 702*a*, 702*b*, and 704. This step 720 is a target internal resistance read-out selection step, in which a target resistance value stored in the data memory 122 is read out and used at the time of normal drive start operation in step 733 described later. After a new target internal resistance is readout and stored in the foregoing step 710 during driving, the latest target internal resistance value calculated in the foregoing step 710 is used. An apparatus for carrying out this step is called internal resistance reading means.

Step 721 acts subsequently to the foregoing step 720 or step 723 described later, and in which whether or not the current internal resistance of the electric heater 119 calculated on the basis of the signal voltage Vr of FIG. 6 coincides with the target internal resistance read out in step 720 is judged. Step 723 acts when the result of comparison is 'not coincident' in step 721, and supply of power to the electric heater 119 is controlled to control the on/off ratio of the switching element 126.

A process consisting of steps 720 to 723 is called step block 724. This step block 724 is to explain operation of second heater control means in which if current internal resistance is smaller than a target value, the electric heater 119 is supplied with stronger power and is heated to raise the internal resistance of the electric heater 119. On the other hand, if the current internal resistance is larger than the target value, supply of power to the electric heater 119 is decreased to lower the internal resistance of the electric heater 119.

Step 725 acts when the judgment result is 'coincident' in the foregoing step 721, and in which the current oxygen-concentration detection output Ip is read out to the arithmetic memory 123. Step 726 acts subsequently to the foregoing step 725, and in which the standard characteristic representing a relation between the oxygen-concentration detection output and the air-fuel ratio preliminarily stored in the program memory 121*b* is read out. Step 727 acts subsequently to the foregoing step 726, and in which current air-fuel ratio is calculated on the basis of the current oxygen-concentration detection output Ip read out in the foregoing step 725 and the standard characteristic data read out in the foregoing step 726. This step 727 is described later in detail with reference to FIG. 9.

Step 730 acts when the judgment result is NO in the foregoing step 713 or acts subsequently to the foregoing step 714 or 727, and in which whether or not a part of the data in the arithmetic memory 123 is to be evacuated is judged. For example, the evacuation operation is carried out immediately after the power supply switch 102 is interrupted, and a delay power supply interrupting circuit not shown continues to supply power to the control power supply circuit 128 until the evacuation operation is completed.

Step 731 acts when it is judged that evacuation operation is to be carried out in the foregoing step 730, and in which whether it is the first operation or not is judged by monitoring if the initial value is written in step 732 described later. Step 732 acts when it is judged the first operation in the foregoing step 731, and the first time internal resistance read out and stored in the foregoing step 710 is transferred to the data memory 122.

Step 733 acts when it is judged not the first operation in the foregoing step 731 or acts subsequently to the foregoing step 732. In this step 733, the value of the internal resistance calculated in the foregoing step 710 is transferred to the data memory 122, and the current time of the current time clock not shown is read out and stored. Step 734 is an operation end step acting when it is judged that any evacuation operation is not necessary in the foregoing step 730 or acts subsequently to the foregoing step 733. The foregoing steps 732 and 733 act as initial value evacuating and transferring means and current value evacuating and transferring means, and a part of data in the arithmetic memory 123 is transferred to and stored in the data memory 122 acting as a nonvolatile memory before stopping operation of the engine.

The foregoing operation is summarized again as follows. The engine control system according to Embodiment 2 of the invention described with reference to FIGS. 6 and 7 is established on the fact that the gas in the exhaust pipe is turned into an atmospheric air state when an environment, in which the engine is not started for a while after the power supply switch 102 is closed, is intentionally created and the engine has been stopped for more than a predetermined time under the special conditions such as final process of assembling a vehicle, confirmation check after maintenance and exchange of the exhaust gas sensor 107 including the electric heater 119, confirmation check after automobile inspection and maintenance, etc. The first heater control means 709 makes a heat control of the electric heater 119 so that the separately calibrated oxygen-concentration detection output Ip0 in the atmospheric air state of the exhaust gas sensor is obtained. The internal resistance of the electric heater 119 at this stage is measured and stored, and the second heater control means 724 makes a heat control of the electric heater 119 using the measured and stored internal resistance as a target value during driving the engine.

As a result, it is possible to avoid influence of variation in internal resistance of the electric heater 119. Even when the oxygen-concentration detection output characteristic or the internal resistance has changed with the passage of time, a deterioration/error warning is given by the error detecting means in step 707 or the deterioration detecting means in step 713.

Embodiment 3

As is clearly understood from the foregoing description, in the invention, the oxygen-concentration detection output (oxygen-concentration data) of the exhaust gas sensor under the condition of the exhaust gas being in the atmospheric air state is kept at a calibration initial value at all times. This makes it possible to avoid influence of variation in characteristic of the exhaust gas sensor and electric heater as well as influence of change in characteristic due to the passage of time and generate a deterioration warning output when the characteristic has excessively changed with the passage of time and it is not possible to carry out appropriate control.

Figures 8, 9:
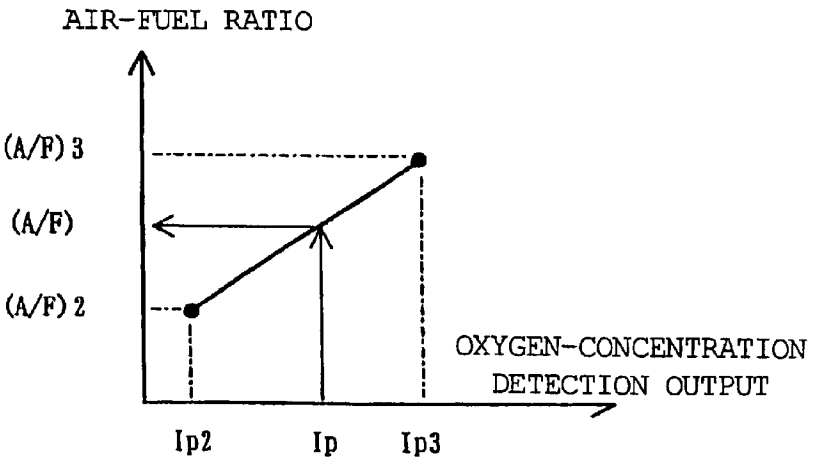
FIG. 8 is an example of a data table of a standard characteristic storage memory.
FIG. 9 is a characteristic graph for explaining interpolation calculation.

FIG. 8 shows an example of characteristic data preliminarily stored in the program memories 121*a* and 121*b*. The oxygen concentration Ip0 indicates an atmospheric air oxygen-concentration detection output serving as a reference value, and Ip1 to Ip5 indicate oxygen-concentration detection outputs corresponding to the air-fuel ratios (A/F)1 to (A/F)5.

FIG. 9 shows that if the oxygen-concentration detection output Ip during driving is within a range between the foregoing Ip2 and Ip3, the current air-fuel ratio (A/F) is calculated through linear interpolation. A calculating machine consisting of a microprocessor, each memory and the foregoing software is called air-fuel ratio calculating means.

The compensation calculation in the foregoing description is described in the form of interpolation calculation based on the data table corresponding to a multistage line graph. It is also preferable to establish an approximate expression representing the whole characteristic and store an equation of the foregoing approximate expression and a constant for the standard characteristic as described below.

The following is an example of the approximate expression of the standard characteristic of the exhaust gas sensor 107:

$$Ip=-2.17\lambda+13.28-11.11/\lambda \quad (5)$$

where:

$$\lambda=(A/F)/14.57 \quad (6)$$

$$Ip0=6.00 \quad (7)$$

If the oxygen-concentration detection output measured during driving the engine is Ip, the value of Ip is substituted for Ip in the expression (1), and (A/F) is calculated by inverse operation.

Figure 7:
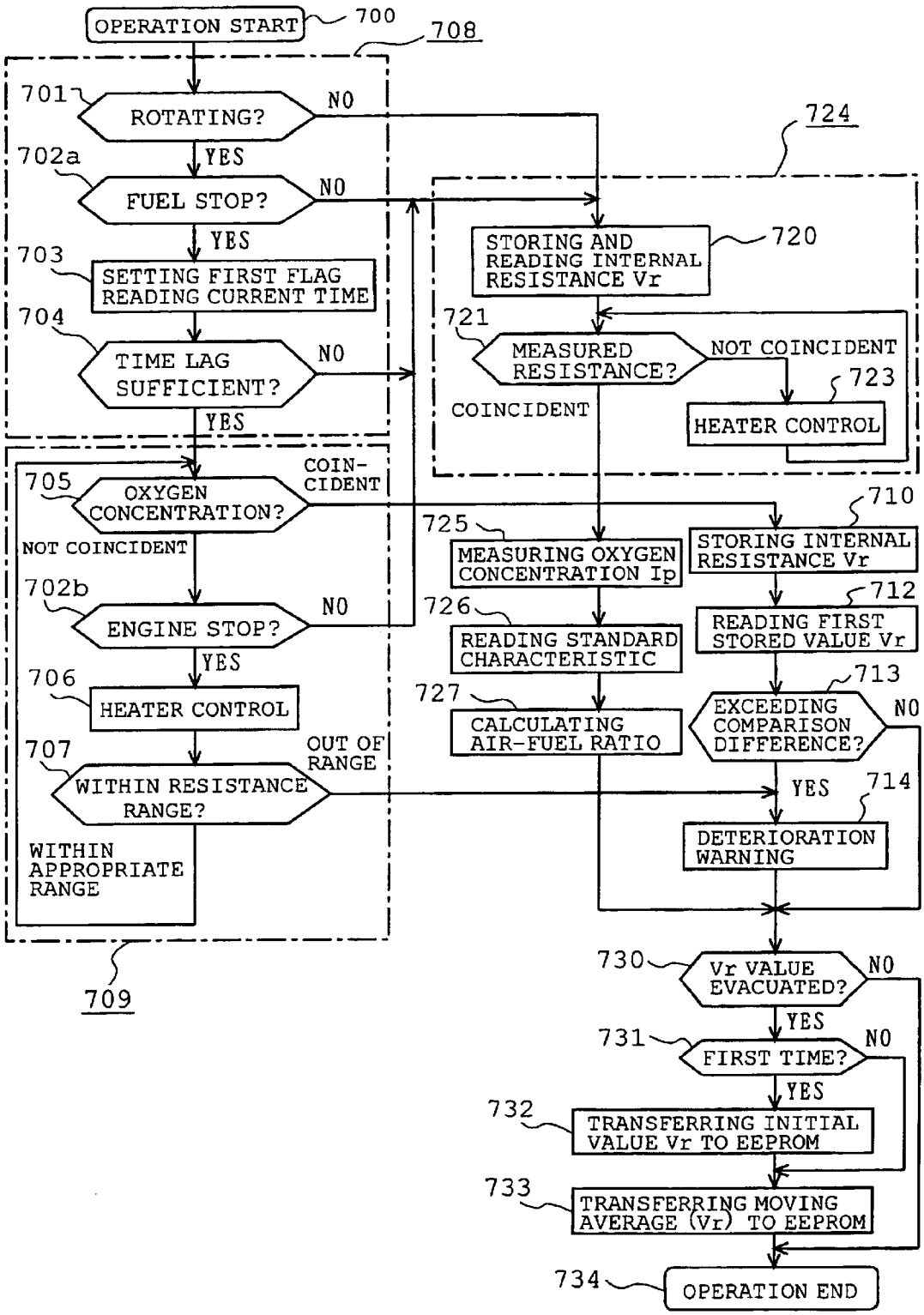
FIG. 7 is a flowchart for explaining operation of the engine control system in FIG. 6.

In addition, a lower limit value R1 and an upper limit value R2 of the internal resistance shown in FIG. 8 show an allowable variation range of the internal resistance of the exhaust gas sensor 107 or the electric heater 119 used in step 507 of FIG. 5 or step 707 of FIG. 7. This regulation of range is mainly to prevent overheat and burnout of the electric heater 119.

Accordingly, it is also preferable to regulate only the lower limit resistance as a limit resistance in the case of the internal resistance of the exhaust gas sensor 107 that decreases as the temperature rises and regulate only the upper limit resistance as the limit resistance in the case of the internal resistance of the electric heater that increases as the temperature rises.

There is a possibility that data of a temporary target resistance R0 shown in FIG. 8 is selected and read out in step 520 in FIG. 5. It not always necessary to set the foregoing temporary target resistance R0 since the target internal resistance is determined before the first driving in Embodiment 2 of FIG. 6.

In the case of Embodiment 1 of FIG. 1, if the value of R0 is established as a predetermined multiplication value, by which the foregoing limit resistance is multiplied, it is not necessary to directly set a temporary target value.

Additionally, in the conventional method of detecting oxygen concentration using an exhaust gas sensor, considering the variation in internal resistance of the exhaust gas sensor or the electric heater used as a reference of temperature control and change in internal resistance due to the passage of time, it has been necessary to devise a method so that there is little change in oxygen-concentration detection characteristic even in the case of change in activation environmental temperature of the exhaust gas sensor.

On the other hand, according to this invention, any change in oxygen-concentration detection characteristic due to the passage of time is compensated by variably controlling the environmental temperature to maintain a stable oxygen-concentration detection characteristic for a long time. In this sense, it is desirable to improve the engine control system so that dependence of the oxygen-concentration detection characteristic on the temperature is increased for stable control of temperature.

In the engine control system of this invention, the atmospheric air state judging means is provided with the scavenging air detecting means. As a result, there is an advantage of preventing detection of a wrong target value by making the calibration signal reading means effective only when the gas in the exhaust pipe has accurately changed into the atmospheric air state under the driving condition of stopping fuel supply to the rotating engine.

The foregoing atmospheric air state judging means is provided with the time lag detecting means. As a result, there is an advantage of preventing detection of a wrong target value by confirming that the engine has been stopped for a sufficiently long time and making the calibration signal reading means effective only when the gas in the exhaust pipe has accurately changed to an atmospheric air state.

The foregoing calibration signal reading means includes the moving average means. As a result, there is an advantage of attaining stable control by averaging plural target internal resistances obtained every time the first heater control means acts and preventing fluctuations in target internal resistance of the second heater control means.

The foregoing exhaust gas sensor is provided with the gas-detecting chamber, the oxygen reference generation current supply circuit, a pump current supply circuit, the internal resistance detection circuit, the calibration resistor, and the electric heater. The internal resistance detection circuit monitors activation state of the foregoing exhaust gas sensor and the oxygen-concentration detection output of the gas-detecting chamber is obtained by detecting the pump current. As a result, a wide range of oxygen-concentration detection output is obtained, and the environmental temperature of the exhaust gas sensor itself is directly detected without using any special temperature sensor in combination with the exhaust gas sensor. As a result, there is an advantage of improving economy.

The calibration resistor is disposed only on the oxygen-concentration detection output side and is not always necessary to be disposed in the internal resistance detection circuit. As a result, there is an advantage of obtaining a miniaturized and inexpensive exhaust gas sensor.

The microprocessor is provided with a program memory such as flash memory, a nonvolatile data memory such as EEPROM memory, and an arithmetic memory such as RAM memory. A part of the region of the foregoing program memory or the nonvolatile data memory is used for the standard characteristic storage memory. Characteristic data are transferred from the external tool connected when the engine control system is adjusted at the time of dispatch or inspected for maintenance, and the characteristic data are written in the standard characteristic storage memory. The target internal resistance value from the calibration signal reading means or the moving average value as to the target internal resistance is stored in the arithmetic memory and is used, and the average is evacuated and stored in the nonvolatile data memory when the engine is stopped. It is therefore possible to arrange the engine control system so that even if the engine is stopped and the battery is detached and attached, past data are still held, and historical information of the past can be read out and displayed by the external tool.

The engine control system is provided with the initial value evacuating and transferring means and the deterioration detecting means. As a result, there is an advantage of generating an error warning output in response to the judgment of the deterioration detecting means.

Further, the engine control system is provided with appropriate resistance range data and the error detecting means. As a result, there is an advantage of generating an error warning output in response to the judgment of the error detecting means and preventing overheat and burnout of the electric heater.

The engine control system is provided with the current value evacuating and transferring means and the internal resistance reading means. As a result, there is an advantage of controlling the electric heater on the basis of the latest information by using the latest stored value or the moving average value obtained from the foregoing current value evacuating means in normal drive start operation. After the foregoing calibration signal reading means reads and stores a new target internal resistance during driving the engine, the foregoing read and stored value or the moving average value of the plural foregoing read and stored values is used for the control.

The foregoing standard characteristic storage memory includes the temporary target internal resistance data. As a result, there is an advantage of roughly controlling the electric heater so as to bring the temperature thereof proximate to the environmental temperature near the activation temperature by reading out the foregoing temporary target resistance value and using it in first drive start operation, even when the target internal resistance has not been calculated yet.

The engine control system according to the invention is applicable not only to internal combustion engine for vehicle but also to internal combustion engine for independent electric power plants, ships, aircrafts, and agricultural civil engineering machines.

What is claimed is:

1. An engine control system comprising:

an exhaust gas sensor having a sensor element that is provided with an electric heater for controlling temperature near the sensor element and appropriately operating at a predetermined activation temperature, measuring oxygen concentration of exhaust gas of the engine and outputting oxygen-concentration data, and outputting predetermined oxygen-concentration data when said exhaust gas is in an atmospheric air exchange state and the temperature near said sensor element is at the predetermined activation temperature;

a standard characteristic storage memory in which a functional expression or a data table showing a relation between said oxygen-concentration data and an air-fuel ratio of said engine at said predetermined activation temperature and oxygen-concentration data in the mentioned atmospheric air exchange state are stored;

atmospheric air judging means for judging an atmospheric air state to determine that said exhaust gas is in an atmospheric air exchange state that the exhaust gas has been exchanged with said atmospheric air when fuel supply to the mentioned engine has been stopped exceeding a predetermined time;

first heater control means that controls said electric heater so that said oxygen-concentration data coincide with the oxygen-concentration data stored in said standard characteristic storage memory when said atmospheric air state judging means judges that the exhaust gas is in the atmospheric air state;

calibration signal reading means that stores internal resistance of said exhaust gas sensor or internal resistance of said electric heater at the point of time when the oxygen-concentration data outputted by said exhaust gas sensor being controlled by said first heater control means comes to coincide to said standard value data as a target internal resistance;

second heater control means that operates when fuel is supplied to said engine to control the foregoing electric heater so that a current value of said internal resistance of said exhaust gas sensor or the electric heater coincides to said target internal resistance; and air-fuel ratio calculating means that has a microprocessor and calculates the current air-fuel ratio on the basis of the current oxygen-concentration data of said exhaust gas sensor controlled by said second heater control means and said functional expression or data table stored in said standard characteristic storage memory.

2. The engine control system according to claim 1, wherein said atmospheric air state judging means is provided with scavenging air judging means for judging that the exhaust gas in an exhaust pipe has been exchanged with said atmospheric air by detecting that an integrated value of an engine intake air amount or an integrated value of an engine speed exceeds a predetermined value under fuel-cut driving condition that fuel supply to said engine has been continuously stopped.

3. The engine control system according to claim 1, wherein said atmospheric air state judging means is provided with time lag detecting means for judging that a time lag from the time when a power supply switch for driving said engine is turned off to the time when said power supply switch is turned on exceeds a predetermined value and that said exhaust gas has been exchanged with the atmospheric air when said engine is stopped.

4. The engine control system according to claim 1, wherein said calibration signal reading means includes moving average means that calculates an average value of predetermined numbers of latest target internal resistances among plural target internal resistances obtained every time said first heater control means is performed.

5. The engine control system according to claim 1, wherein said exhaust gas sensor comprises:

a gas-detecting chamber that includes a gas passage wall composed of a gas diffusion porous material, an oxygen pump element composed of a zirconia solid electrolyte material, and an oxygen-concentration cell element, a part of the exhaust gas of said engine being permitted to pass through said gas-detecting chamber;

an oxygen reference generation current supply circuit for supplying an oxygen reference generation electric current to said oxygen-concentration cell element;

a pump current supply circuit for controlling a pump current of said oxygen pump element so that the oxygen concentration of said gas-detecting chamber comes to be an established value;

an internal resistance detecting circuit for detecting an internal resistance when a predetermined high-frequency current flows through said oxygen-concentration cell element;

a calibration resistor for compensating the oxygen-concentration data of said exhaust gas sensor at a predetermined activation temperature when said exhaust gas is in the atmospheric air state and calibrating so that the oxygen-concentration data of a first article of the exhaust gas sensor is equal to standard value data stored in said standard characteristic storage memory; and an electric heater that is disposed near said gas-detecting chamber and activates and heats said gas-detecting chamber while monitoring the resistance detected by said internal resistance detection circuit; and wherein the oxygen-concentration data of the gas-detecting chamber is obtained by detecting said pump current.

6. The engine control system according to claim 1, wherein said microprocessor includes a program memory such as flash memory, a nonvolatile memory such as FEPROM, and an arithmetic memory such as RAM memory;

said standard characteristic storage memory includes said program memory or said nonvolatile data memory, and in which characteristic data are transferred from an external tool and written in said standard characteristic storage memory; and the engine control system further comprising data storing means in which a moving average value as to a target internal resistance value or target internal resistance stored in said arithmetic memory and used is evacuated and stored in said nonvolatile data memory when the engine is stopped.

7. The engine control system according to claim 6, further comprising:

initial value evacuating and transferring means that writes and stores a first stored value or an initial average stored value of the target internal resistance stored in said arithmetic memory in said nonvolatile data memory;

deterioration detecting means for judging that said exhaust gas sensor has deteriorated when a difference between a current target internal resistance and said first stored value or said initial average stored value exceeds a predetermined value; and warning means that generates a error warning output in response to judgment of said deterioration detecting means.

8. The engine control system according to claim 6, further comprising:

appropriate resistance range data stored in said standard characteristic storage memory to regulates an allowable variation range of the internal resistance when temperature of said exhaust gas sensor is high; and error detecting means for judging that there is any error in said exhaust gas sensor when said internal resistance is out of said appropriate resistance range data when sand first heater control means makes a heat control of said exhaust gas sensor and makes a control of power application to said electric heater so that the oxygen-concentration data coincide with the standard value data of the oxygen-concentration data in the atmospheric air state stored in said standard characteristic storage memory;

wherein an error warning output is generated in response to judgment of said error detecting means.

9. The engine control system according to claim 6, further comprising:

current value evacuating and transferring means that writes and stores the latest stored value or a moving average value of plural target internal resistances read by said calibration signal reading means and stored in said arithmetic memory; and internal resistance reading means for determining an internal resistance of said exhaust gas sensor used as a target value for the control of said electric heater by said second heater control means;

wherein as for the internal resistance read out by said internal resistance reading means, the latest stored value or the moving average value obtained from said current value evacuating means is used at normal drive start operation, and said read and stored value or said moving average value of plural values read and stored is used after said calibration signal reading means reads and stores a new target internal resistance during driving the engine.

10. The engine control system according to claim 9, wherein said standard characteristic storage memory includes temporary target internal resistance data stored in said standard characteristic storage memory and used until the target internal resistance is calculated by said first heater control means, and said internal resistance reading means reads and uses said temporary target resistance value at first drive start operation for control of said electric heater by said second heater control means.

* * * * *